US010151087B1

(12) United States Patent
Wang

(10) Patent No.: US 10,151,087 B1
(45) Date of Patent: Dec. 11, 2018

(54) WATER DISPENSER

(71) Applicant: Zhejiang Delifu Technology Co., Ltd, Ningbo (CN)

(72) Inventor: Guofei Wang, Ningbo (CN)

(73) Assignee: ZHEJIANG DELIFU TECHNOLOGY CO., LTD, Ningbo (CN)

( * ) Notice: Subject to any disclaimer, the term of this patent is extended or adjusted under 35 U.S.C. 154(b) by 0 days.

(21) Appl. No.: 15/705,260

(22) Filed: Sep. 15, 2017

(30) Foreign Application Priority Data

Aug. 14, 2017 (CN) ..... 2017 1 0689989

(51) Int. Cl.
*E03C 1/23* (2006.01)

(52) U.S. Cl.
CPC ..... *E03C 1/2302* (2013.01)

(58) Field of Classification Search
CPC ..... E03C 1/23; E03C 1/2302; E03C 1/2304
USPC ..... 4/689–692
See application file for complete search history.

(56) References Cited

U.S. PATENT DOCUMENTS 8,079,098 B2 * 12/2011 Thomas ..... E03C 1/2302 4/689
2009/0007322 A1 * 1/2009 Taylor ..... E03C 1/23 4/293
2012/0199213 A1 * 8/2012 Reavis ..... E03C 1/2302 137/15.24

FOREIGN PATENT DOCUMENTS

CN 202509584 U 10/2012

* cited by examiner

*Primary Examiner* — Tuan N Nguyen
(74) *Attorney, Agent, or Firm* — Wayne & King LLC

(57) ABSTRACT

Embodiments of the present disclosure disclose a water dispenser comprising a sewer tube, a connecting pole, a connecting seat having a sewer outlet, and a sewer lid to close or open the sewer outlet. The connecting seat is connected to the sewer tube. The connecting pole is inside the sewer tube. The sewer lid is connected to an upper end of the connecting pole. The sewer tube comprises a fixing seat on a side wall. The fixing seat comprises a driving component to drive the connecting pole. The driving component comprises a swing component, a swing component mounting seat, a connecting steel wire and a handle. The swing component is hinged to the swing component mounting seat to enable the swing component to swing with a hinge shaft as a center.

6 Claims, 15 Drawing Sheets

WATER DISPENSER

CROSS-REFERENCE TO RELATED APPLICATIONS

This application claims priority to Chinese Patent Application No. 201710689989.5 with a filing date of Aug. 14, 2017. The content of the aforementioned applications, including any intervening amendments thereto, are incorporated herein by reference.

TECHNICAL FIELD

The present disclosure relates to the field of water dispensers, and more particularly, to a water dispenser which enables its sewer lid to stay in any position as it opens or closes.

BACKGROUND OF THE PRESENT INVENTION

Water dispensers are widely used for cleaning sinks, basins, and bathtubs, and make an indispensable part of kitchen and toilet products.

Existing water dispensers in the market usually comprise a rotatably connected sewer lid. When it is needed to preserve water, the sewer lid is turned to a horizontal position so that a sewer outlet is blocked. When it is needed to drain water, the sewer lid is manually turned to a vertical position. The human hand must contact water in the cleaning basin before water can be drained. In winter, the user might find such an approach chilling and unhealthy since he or she would have to immerse a hand in used water.

Therefore, a water dispenser which allows opening and closing of the sewer lid by operating a switch has been designed. As disclosed in CN202509584U, a sewer device of a cleaning basin comprises an operating switch, a sewer blocking mechanism, and a connecting steel wire. The operating switch is provided with a vertical movement component and button. One end of the connecting steel wire is connected to the vertical movement component. The operating switch provides two staying positions where the vertical movement component can stay at different heights by moving the connecting steel wire. The sewer blocking mechanism comprises a sewer lid and its lift connecting pole. The other end of the connecting steel wire is connected to a transmission mechanism which actuates the lift connecting pole to lift.

The CN202509584U patent uses an operating switch to open or close the sewer lid, but there still some disadvantages:

1. Only two staying positions are provided. Therefore, the sewer lid may only switch between an open state and a closed state. Due to elaborate and diversified needs of users, a user may prefer that the sew lid can stay at any position to control the rate of water drainage. The CN202509584U patent can not satisfy such needs.

2. The sewer can be switched from the open state to the closed state only by operating an operating switch. When such water dispensers are used in public areas, some people may be accustomed to pressing the sewer lid to close it. Since the holding force applied to the open sewer lid is provided by a clamping limitation structure in the operating switch, pressing the sewer lid with hands would fail to close it. If the user applies an excessive force, the product may be damaged.

3. The sewer blocking mechanism must be disassembled before it can be removed for cleaning.

SUMMARY OF PRESENT INVENTION

One objective of the present disclosure is to solve at least some of the problems of the prior arts by providing a water dispenser which allow the sew lid to stay at any position to control the rate of water drainage.

Embodiments of the present disclosure disclose a water dispenser comprising a sewer tube, a connecting pole, a connecting seat having a sewer outlet, and a sewer lid to close or open the sewer outlet. The connecting seat is connected to the sewer tube. The connecting pole is inside the sewer tube. The sewer lid is connected to an upper end of the connecting pole. The sewer tube comprises a fixing seat on a side wall. The fixing seat comprises a driving component to drive the connecting pole. The driving component comprises a swing component, a swing component mounting seat, a connecting steel wire and a handle. The swing component is hinged to the swing component mounting seat to enable the swing component to swing with a hinge shaft as a center. The handle is connected to an end of the connecting steel wire. The other end of the connecting steel wire is connected to an end of the swing component. The other end of the swing component is used to drive the connecting pole to move along the sewer tube so that the sewer lid closes or opens the sewer outlet, and a limiting component is arranged between the swing component and the swing component mounting seat to limit the swing component so that the swing component can stay in a determined position during swinging.

In some embodiments, the swing component mounting seat comprises a first seat body and a second seat body. The first seat body is located on a side of the swing component which is near the sewer tube. The second seat body is located on a side of the swing component which is away from the sewer tube. The first seat body and the second seat body comprise a swing component mounting cavity. The swing component is arranged in the swing component mounting cavity. The limiting component is characterized in that the swing component comprises a spherical ball. The swing component mounting cavity comprises a round cavity adapted to the spherical ball, and the friction force induced by contact of an inner surface of the round cavity with an outer surface of the spherical ball causes the swing component to stay in the determined position during swinging.

In some embodiments, a pad is arranged between the round cavity and the spherical ball.

In some embodiments, the fixing seat comprises a mounting cassette. The mounting cassette comprising a receiving cavity to receive the second seat body, and the mounting cassette and the first seat body comprise clamping components which are mutually clamped.

In some embodiments, the fixing seat comprises a body component arranged on a side wall of the sewer tube and a tweaking component screwed to the body component. The tweaking component comprises a mounting cassette receiving chamber to receive the mounting cassette. The mounting cassette is arranged within the mounting cassette receiving chamber, a gap is formed between the first seat body and the second seat body, an elastic gasket is arranged between the mounting cassette and a bottom of the mounting cassette receiving chamber, and a jump ring is clamped on an outer wall of the mounting cassette.

In some embodiments, the first seat body is mounted on the body component, and a fool-proof component is arranged between the first seat body and the body component.

In some embodiments, the first seat body comprises a baffle part at an end facing the sewer tube.

In some embodiments, the connecting pole comprises an elastic snap joint on an end near the swing component. The elastic snap joint comprises a bayonet, and one end of the swing component is snapped in the bayonet.

In some embodiments, the end of the swing component snapped in the elastic snap joint is an upwardly curved arc.

In some embodiments, the elastic snap joint comprises a guiding component outside the bayonet to guide the end of the swing component until it is snapped in the bayonet.

In some embodiments, the connecting pole and the sewer tube comprise orienting components which are mutually clamped. The orienting component comprises orienting plates arranged on a side of the connecting pole and orienting ribs arranged on the inner wall of the sewer lid. An orienting slit is formed between adjacent orienting ribs. The orienting plate is slidably connected to the orienting slit.

In some embodiments, limiting ribs are arranged circumferentially on the inner wall of the sewer tube and outside the orienting slit to prevent insertion of the orienting plate into the sewer tube in positions of the limiting ribs.

REFERENCE NUMBERS

1, sewer tube, 2, connecting pole, 3, sewer outlet, 4, connecting seat, 5, sewer lid, 6, fixing seat, 7, swing component, 8, swing component mounting seat, 9, connecting steel wire, 10, handle, 11, first seat body, 12, second seat body, 13, swing component mounting cavity, 14, spherical ball, 15, round cavity, 16, pad, 17, recessed cavity, 18, mounting cassette, 19, receiving cavity, 20, hook, 21, locking notch, 22, body component, 23, tweaking component, 24, mounting cassette receiving chamber, 25, elastic gasket, 26, jump ring, 27, baffle part, 28, elastic snap joint, 29, bayonet, 30, orienting plate, 31, orienting ribs, 32, orienting slit, 33, limiting ribs, 34, sliding ribs, 35, radical flange, 36, first teeth, 37, second teeth, 38, sealing ring, 39, first orienting block, 40, second orienting block, 41, orienting surface.

DETAILED DESCRIPTION OF PREFERRED EMBODIMENTS

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific numbers, materials, and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

In addition, the terms "first", "second", and "third" are for illustrative purposes only and are not to be construed as indicating or implicit relative importance.

In the descriptions of the present disclosure, it is to be understood that the terms "provided", "mounted", "arranged", "connected" should be understood in a broad sense unless otherwise expressly defined and specified. For example, it may be a fixed connection, a detachable connection, an integrated connection, a mechanical connection, an electrical connection, a direct connection, an indirect connection through a media or an interconnection between two parts. The terms can be construed according to the understanding of one commonly skilled in the art.

Figure 1:
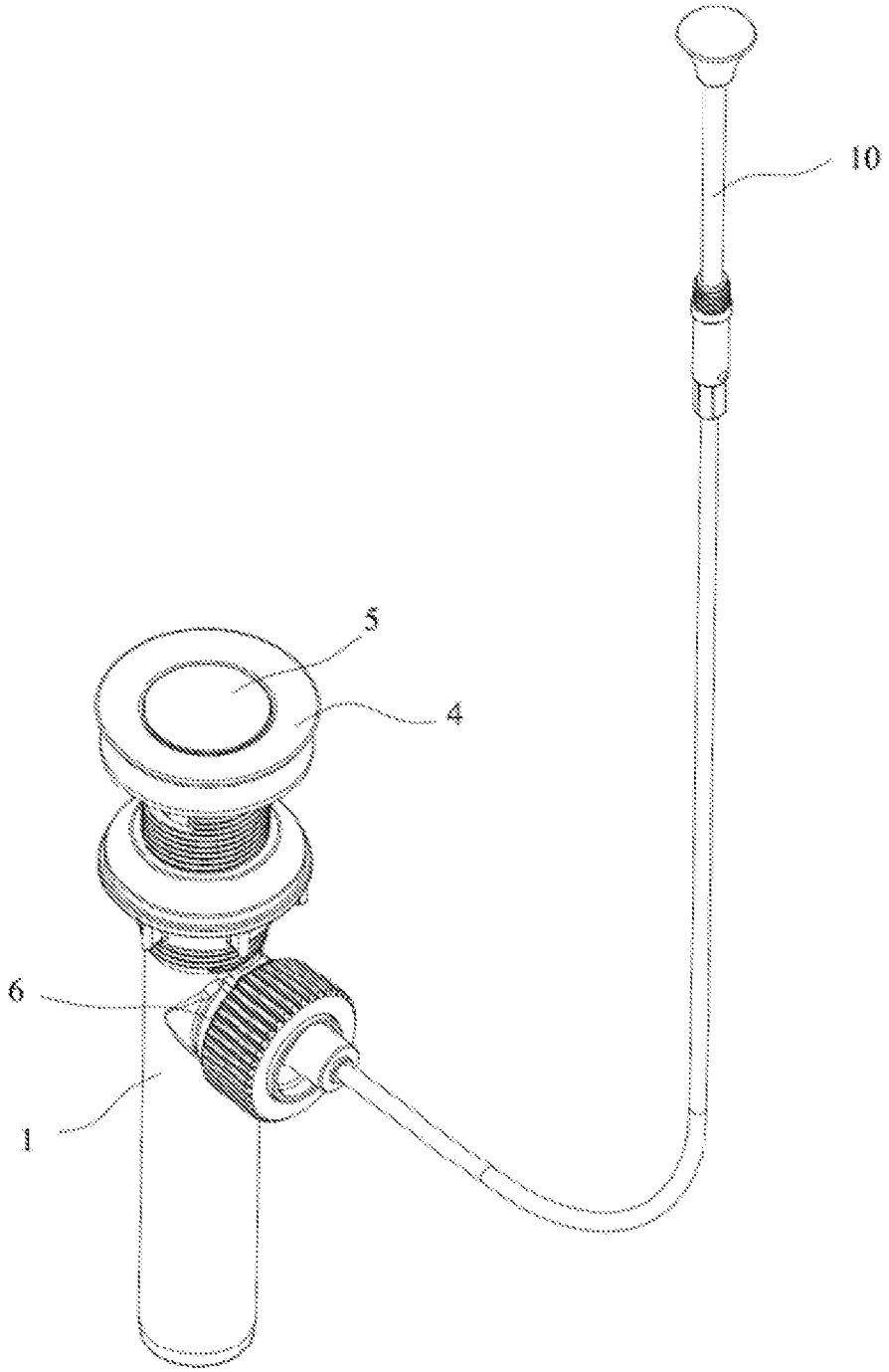
FIG. 1 illustrates the structures of a water dispenser according to some embodiments.
Figure 2:
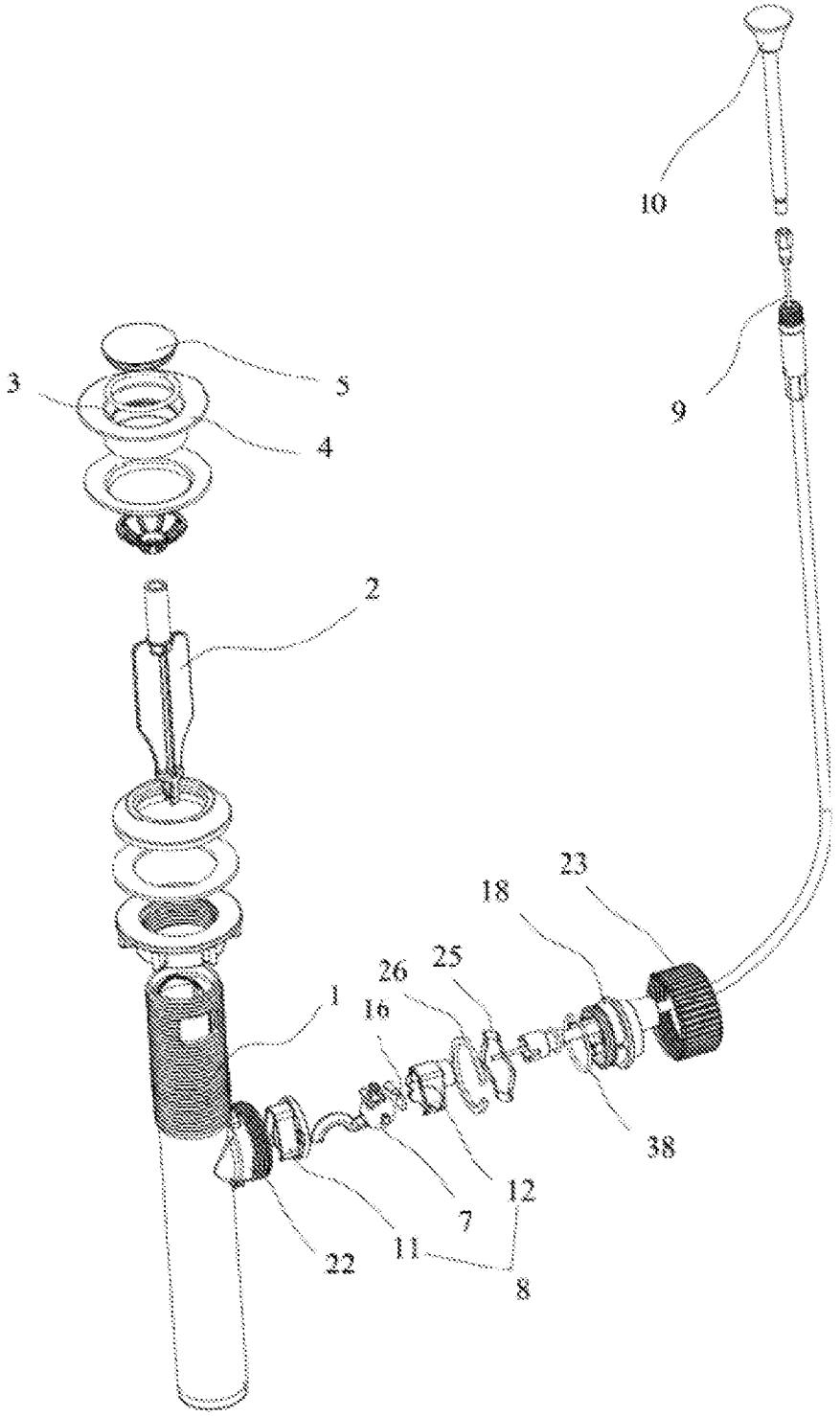
FIG. 2 illustrates the explosive view of a water dispenser according to some embodiments.
Figure 3:
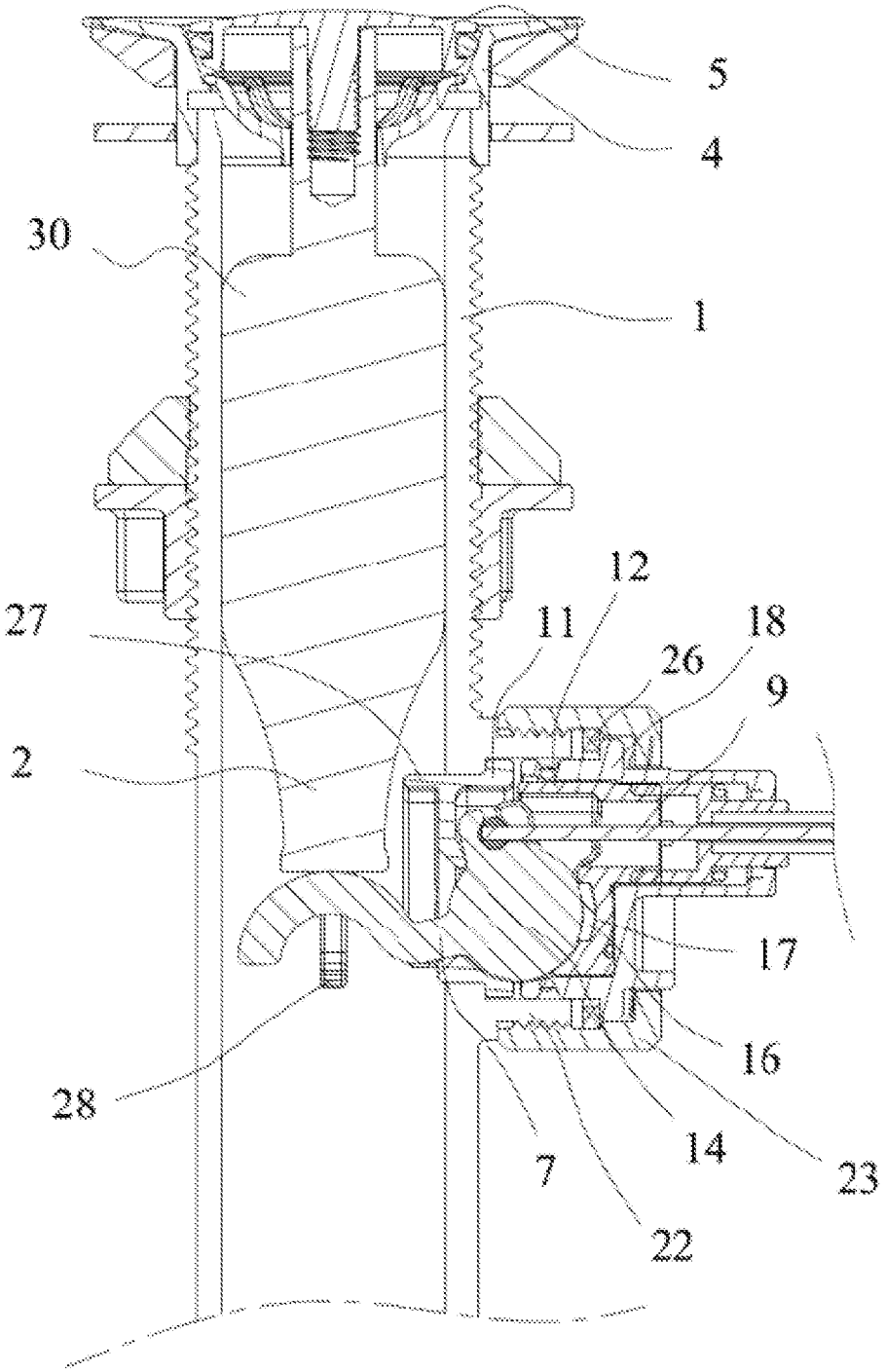
FIG. 3 illustrates a cross-section of a water dispenser with a sewer lid closed according to some embodiments.
Figure 4:
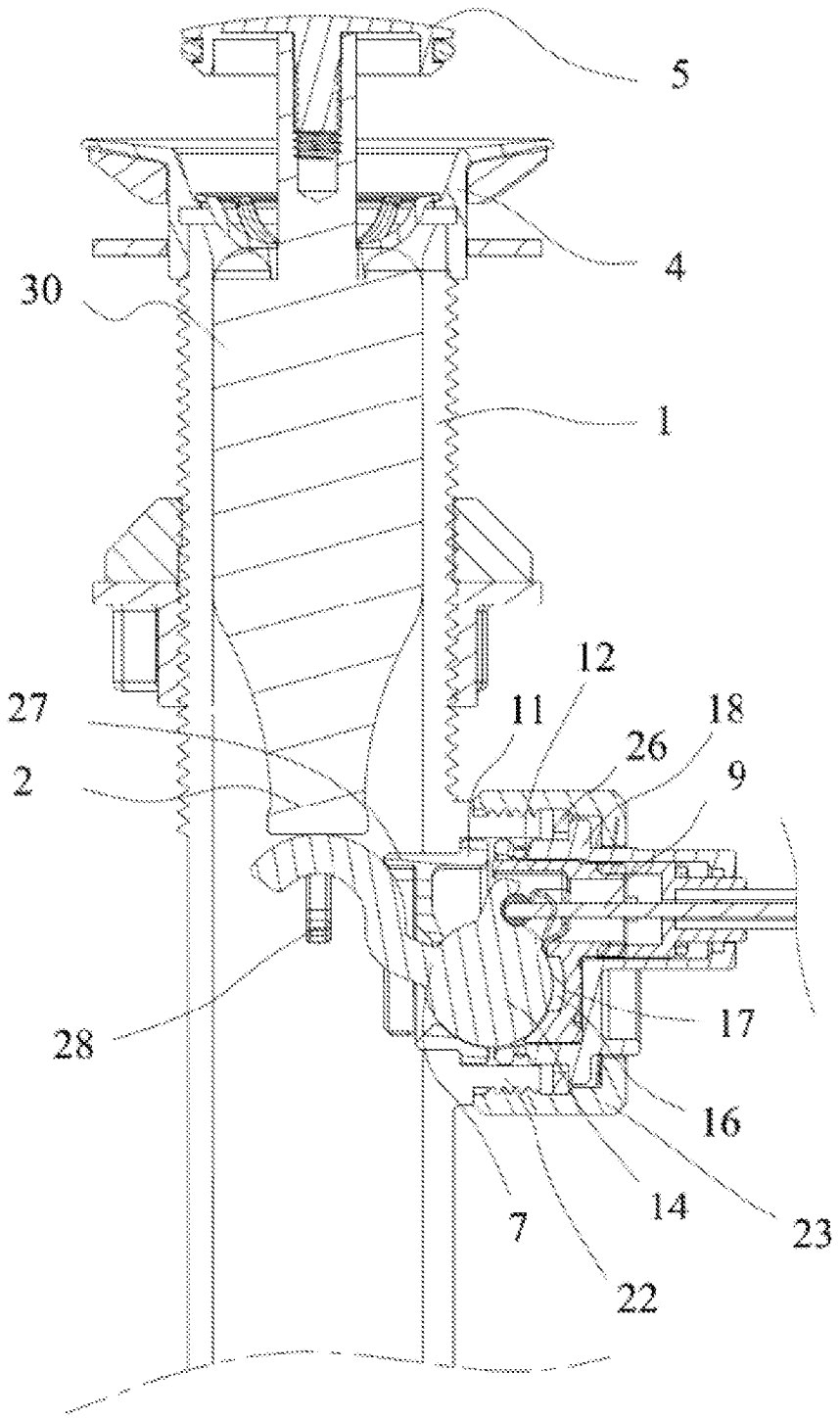
FIG. 4 illustrates a cross-section of a water dispenser with a sewer lid open according to some embodiments.
Figure 5:
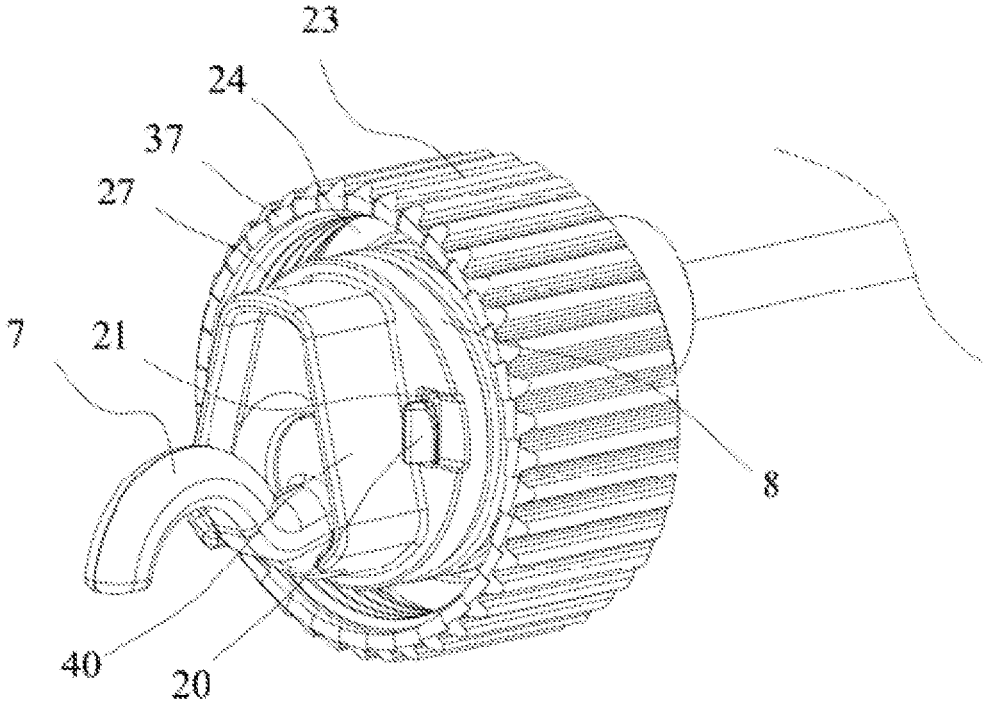
FIG. 5 illustrates a water dispenser with a first seat body, a second seat body, a swing component, a mounting cassette, and an elastic gasket mounted on the tweaking component according to some embodiments.
Figure 6:
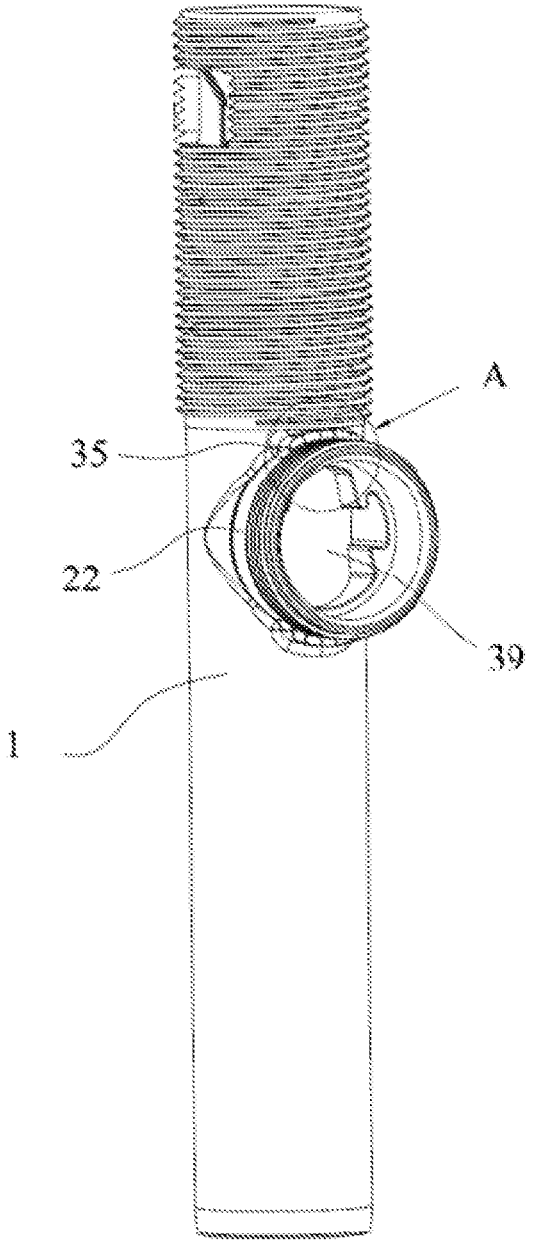
FIG. 6 illustrates the structures of a sewer tube of a water dispenser according to some embodiments.
Figure 7:
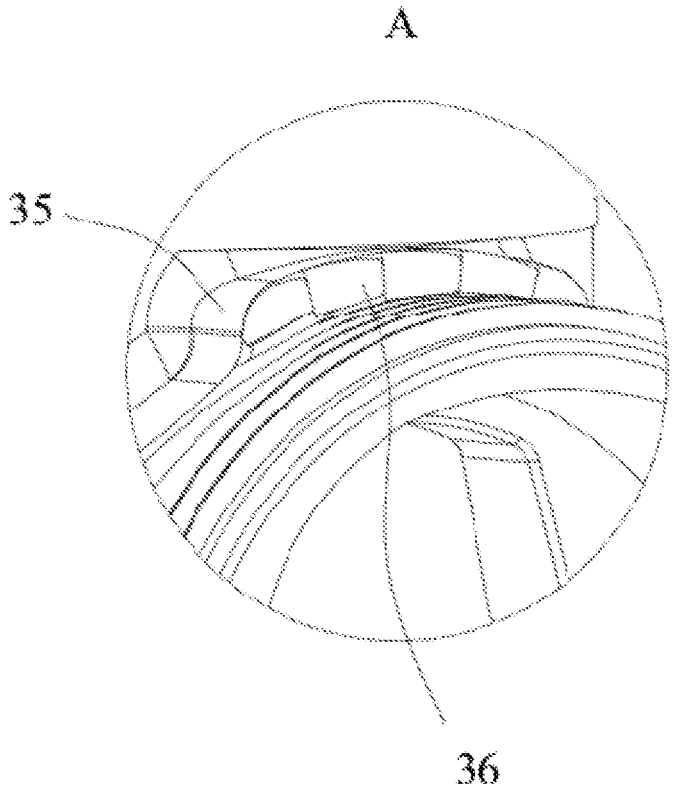
FIG. 7 illustrates an enlarged view of the part A in FIG. 6.
Figure 8:
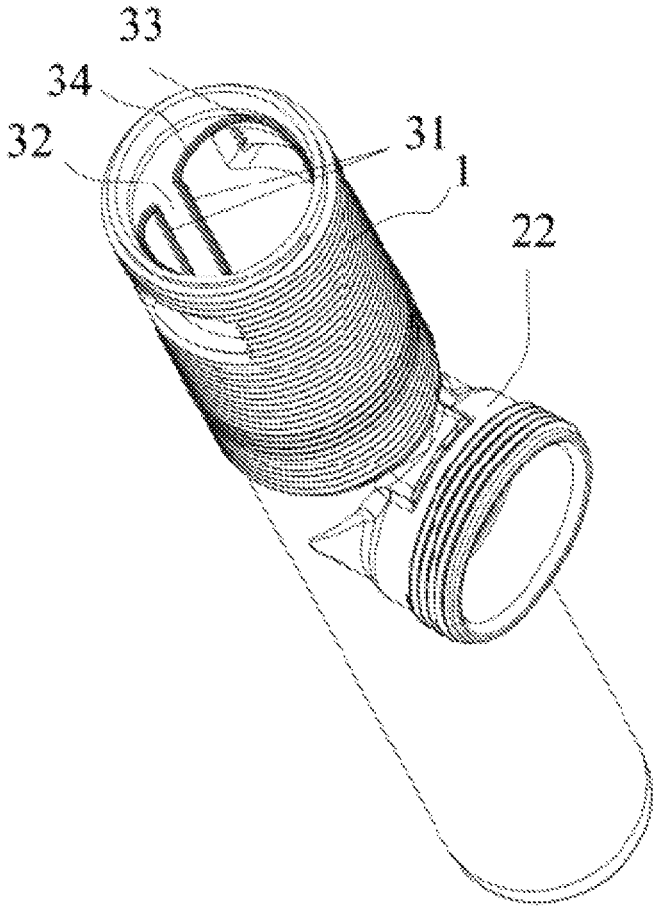
FIG. 8 illustrates another perspective of the structures of a sewer tube of a water dispenser according to some embodiments.
Figure 9:
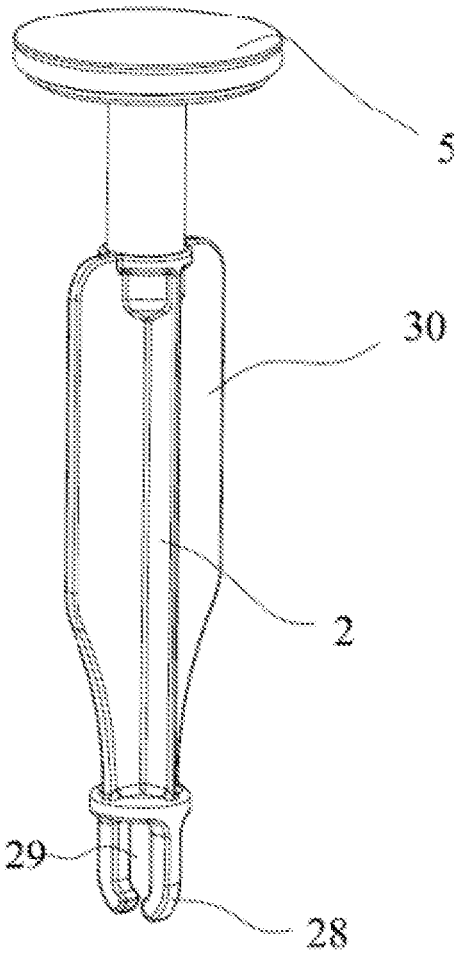
FIG. 9 illustrates a connecting pole and a sewed lid of a water dispenser according to some embodiments.
Figure 10:
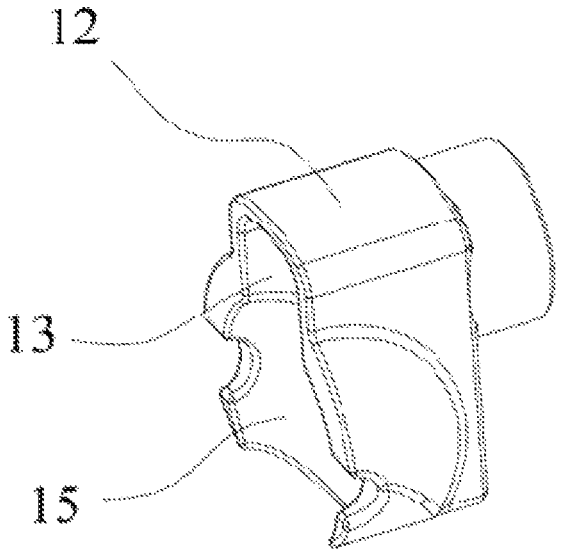
FIG. 10 illustrates a second seat body of a water dispenser according to some embodiments.
Figure 11:
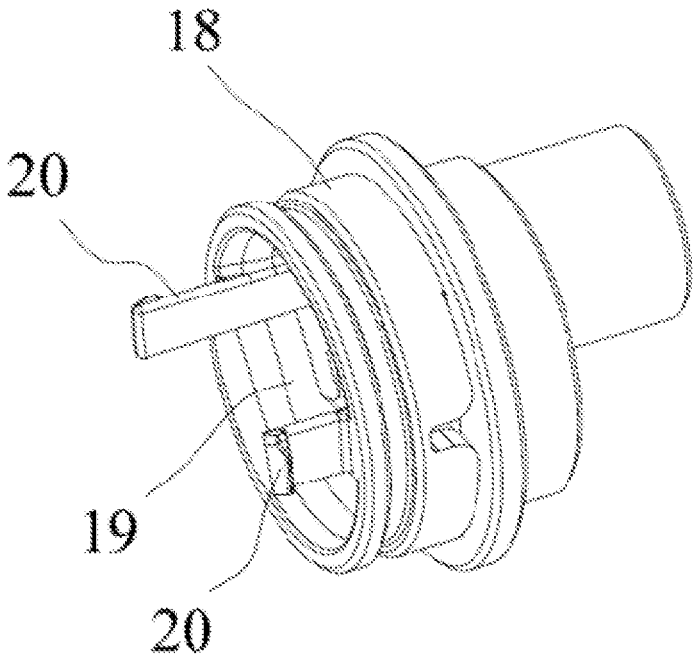
FIG. 11 illustrates a mounting cassette of a water dispenser according to some embodiments.
Figure 12:
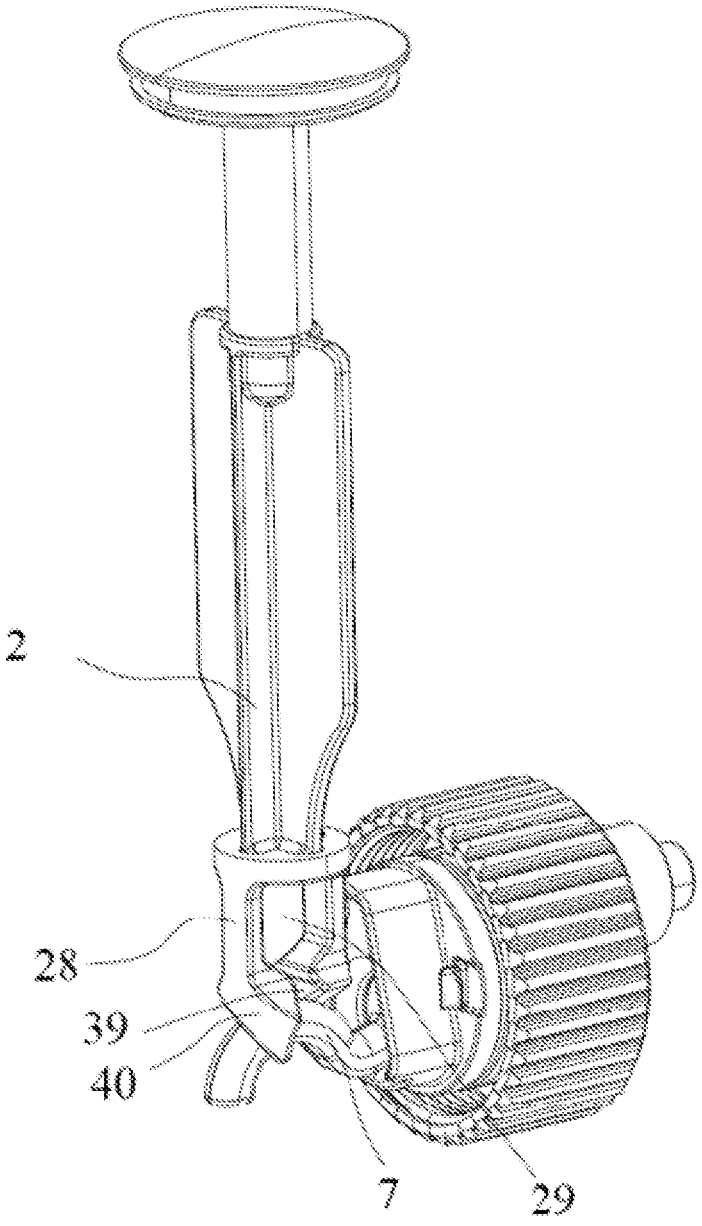
FIG. 12 illustrates a guiding component arranged outside a bayonet of an elastic gasket of a water dispenser according to some embodiments.
Figure 13:
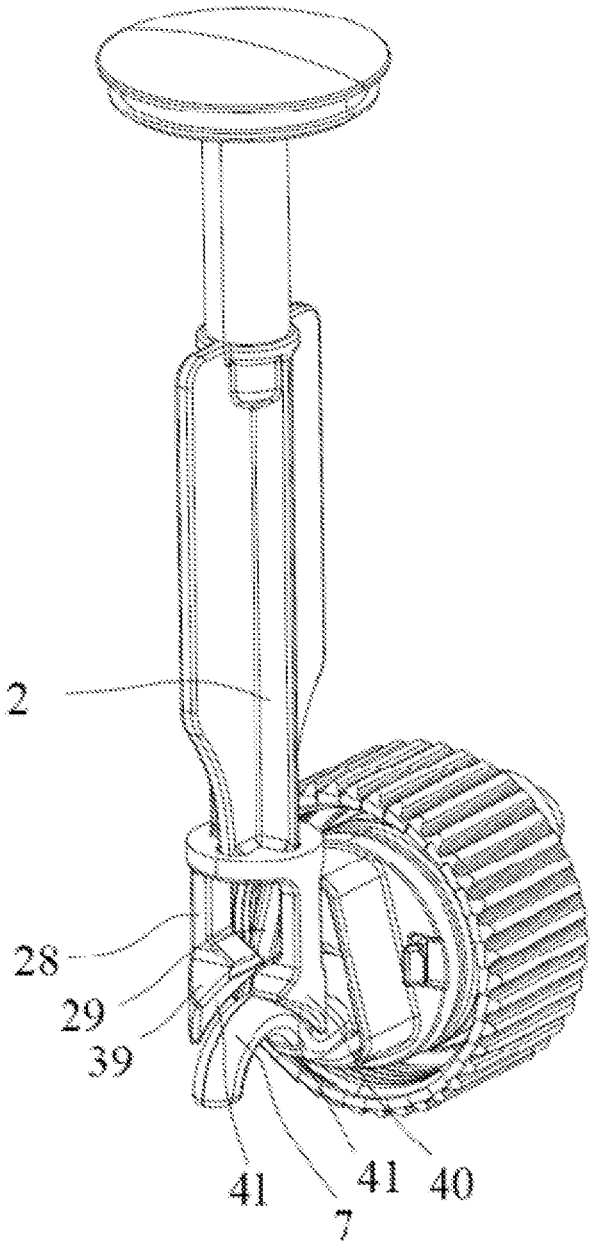
FIG. 13 illustrates a guiding component which rotates an elastic gasket to an end of the swing component to snap into the bayonet according to some embodiments.
Figure 14:
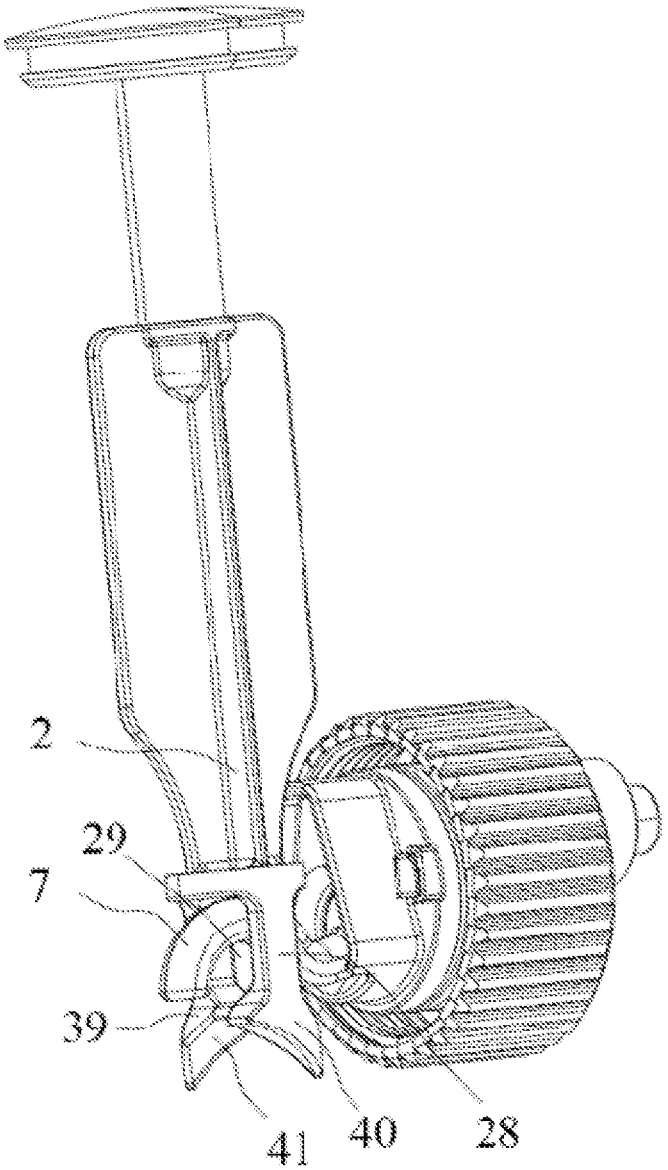
FIG. 14 illustrates an end of the swing component of the water dispenser snapped into the bayonet according to some embodiments.
Figure 15:
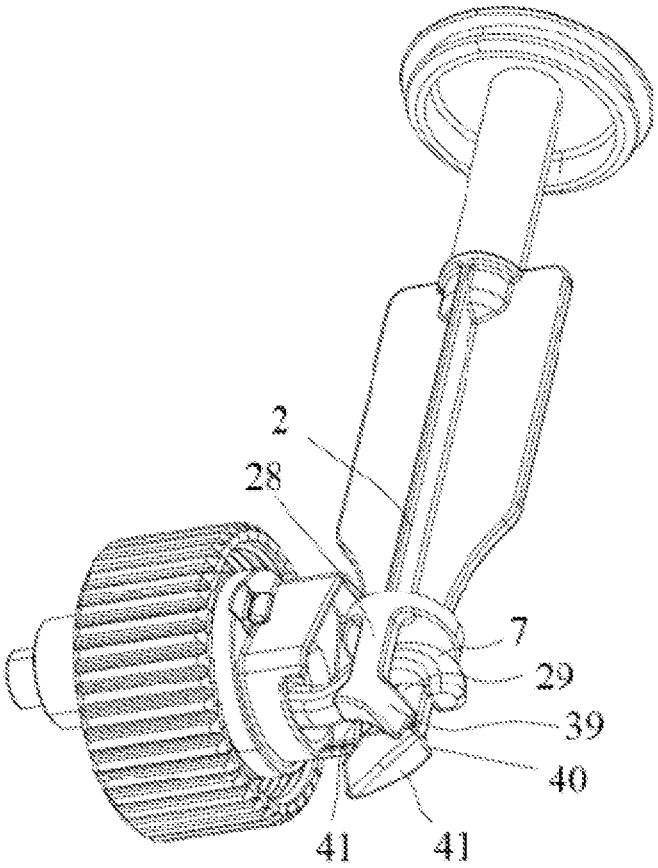
FIG. 15 illustrates another perspective of an end of the swing component of the water dispenser snapped into the bayonet according to some embodiments.

As shown in FIG. 1-15, a water dispenser comprises a sewer tube 1, a connecting pole 2, a connecting seat 4 having a sewer outlet 3, and a sewer lid 5 to close or open the sewer outlet 3. The connecting seat 4 is connected to the sewer tube 1. The connecting pole 2 is inside the sewer tube 1. The sewer lid 5 is connected to an upper end of the connecting pole 2. The sewer tube 1 comprises a fixing seat 6 on its side wall. The fixing seat 6 comprises a driving component to drive the connecting pole 2. The driving component comprises a swing component 7, a swing component mounting seat 8, a connecting steel wire 9 and a handle 10. The swing component 7 is hinged to the swing component mounting seat 8 to enable the swing component 7 to swing with a hinge shaft as a center. The handle 10 is connected to an end of the connecting steel wire 9. The other end of the connecting steel wire 9 is connected to an end of the swing component 7. The other end of the swing component 7 is used to drive the connecting pole 2 to move along the sewer tube 1 so that the sewer lid 5 closes or opens the sewer outlet 3. A limiting component is arranged between the swing component 7 and the swing component mounting seat 8 to limit the swing component 7 so that the swing component 7 can stay in any determined position during swinging.

One end of the swing component 7 can be used to drive the connecting pole 2 to move along the sewer tube 1 in the following fashion: The end of the swing component 7 is hinged to the connecting pole 2 so that the end of the swing component 7 actuates the connecting pole 2, or the end of the swing component 7 is in contact with, but not connected to, the connecting pole 2 as a support to actuate the connecting pole 2.

The swing component mounting seat 8 comprises a first seat body 11 and a second seat body 12. The first seat body 11 is located on a side of the swing component 7 which is near the sewer tube 1. The second seat body 12 is located on a side of the swing component 7 which is away from the sewer tube 1. The first seat body 11 and the second seat body 12 have a swing component mounting cavity 13. The swing component 7 is arranged within the swing component mounting cavity 13. The limiting component is characterized in that the swing component 7 comprises a spherical ball 14. The swing component mounting cavity 13 comprises a round cavity 15 adapted to the spherical ball 14. The friction force induced by the contact of an inner surface of the round cavity 15 with an outer surface of the spherical ball 14 causes the swing component 7 to stay in any determined position during swinging. In this way, friction force becomes the limiting force to limit the swing component 7. The swing component 7 would be capable to stay at an arbitrary position during swinging with a relatively simple structure. The adaption of the spherical ball 14 and round cavity 15 allows the swing component 7 to swing again when needed. Further, the user is able to operate the handle 10 to actuate the connecting pole 2 to close the sewer lid 5 when he or she decides to close the sewer lid 5 which is in the open state because it is the friction force that keeps the swing component 7 in the arbitrary position. Damage to the sewer lid 5 of prior arts when the sewer lid 5 which can only be lifted or declined by a corresponding switch is pressed hard would be avoided.

A pad 16 is arranged between the round cavity 15 and the spherical ball 14. The pad 16 is used to ensure a proper friction force between the inner surface of the round cavity 15 and the outer surface of the spherical ball 14. An overly small friction force would lead to incapability to keep the swing component 7 at any determined position. An overly large friction force would hinder the swing movement of the swing component 7. The presence of the pad 16 avoids such problems. The pad 16 can be a rubber component, a plastic component, or an elastic component. The pad 16 has elastic deformation ability to some extent so that it may adjust the friction force between the inner surface of the round cavity 15 and the outer surface of the spherical ball 14. The pad 16 can be directly positioned between the round cavity 15 and the spherical ball 14. In other embodiments, the pad 16 can be configured in the following fashion: a recessed cavity 17 is provided on the inner surface of the round cavity 15. The pad 16 is within the recessed cavity 17. One end of the pad 16 is in close contact with the recessed cavity 17. The other end of the pad 16 is in close contact with the spherical ball 14. In this way, relative sliding motion of the pad 16 would be prevented, and the pad 16 may adjust the friction force between the inner surface of the round cavity 15 and the outer surface of the spherical ball 14 robustly.

A mounting cassette 18 is comprised within the fixing seat 6. The mounting cassette 18 comprises a receiving cavity 19 to receive the second seat body 12, and the mounting cassette 18 and the first seat body 11 comprise clamping components which are mutually clamped. The clamping components comprise a hook 20 arranged on the cassette 18 and a locking notch 21 arranged on the first seat body 11. The hook 20 is snapped into the locking notch 21. In some embodiments, the positions of the hook 20 and the locking notch 21 can be interchanged. The clamping components enable first seat body 11, the swing component 7, the second seat body 12 and the mounting cassette 18 to be pre-assembled to facilitate a later assembly process.

The fixing seat 6 comprises a body component 22 arranged on a side wall of the sewer tube 1 and a tweaking component 23 screwed to the body component 22. The tweaking component 23 comprises a mounting cassette receiving chamber 24 to receive the mounting cassette 18. The mounting cassette 18 is arranged within the mounting cassette receiving chamber 24. A gap is formed between the first seat body 11 and the second seat body 12. An elastic gasket 25 is arranged between the mounting cassette 18 and a bottom of the mounting cassette receiving chamber 24. A jump ring 26 is clamped on an outer wall of the mounting cassette 18. Due to the presence of the elastic gasket 25, the first seat body 11, the second seat body 12 and the mounting cassette 18 can be fixed when the tweaking component 23 is screwed to the body component 22, thereby improving stability of the entire structure. In some embodiments, the elastic gasket 25 and the pad 16 are both elastic so that the friction force between the inner surface of the round cavity 15 and the outer surface of the spherical ball 14 can be adjusted by the entire structure when fixed together. In further embodiments, a gap exists between the first seat body 11 and the second seat body 12 which would wear out the pad 16 after a long period of usage. The pad 16 would still stay in close contact with spherical ball 14 and adjust the friction force if the elastic gasket 25 is present. In particular, the elastic gasket 25 is a disc spring or corrugated spring. One end of the jump ring 26 is clamped on the outer wall of the mounting cassette 18. and the other end of the jump ring 26 is clamped on the inner wall of the tweaking component 23. In one embodiment, the first seat body 11, the second seat body 12, the swing component 7, the mounting cassette 18 and the elastic gasket 25 are pre-mounted on the tweaking component 23, and the tweaking component 23 is directly mounted on the body component 22 to conclude the assembly. In another embodiment, the user might need to assemble the product by him or her self. The first seat body 11, the second seat body 12, the swing component 7, the mounting cassette 18 and the elastic gasket 25 can be pre-mounted on the tweaking component 23 as a single component and the user can simply mount the tweaking component 23 on the body component 22. User needs and manufacture requirements are both satisfied.

The first seat body 11 is mounted on the body component 22, and a fool-proof component is arranged between the first seat body 11 and the body component 22. In considerations of assembling efficiency and product quality, the fool-proof component prevents mounting the first seat body 11 on the body component 22 if the two are misaligned. Further, the fool-proof component prevents circumferential rotation of the first seat body 11 and the body component 22 and loosening of the first seat body 11 and the body component 22 after a long time of usage. The fool-proof component thus ensures structural stability. Still further, the fool-proof component also plays a role in positioning by ensuring the end of the swing component 7 is inserted into the correct position in the sewer tube 1 after the first seat body 11 is clamped with the body component 22 and facilitating the assembly of the swing component 7 and the connecting pole 2. The fool-proof component comprises a triangular notch 39 in the body component 22 and a triangular connector 40 adapted to the shape of the triangular notch 39 in the first seat body 11. The triangular connector 40 is fitted to the triangular notch 39 to constitute the fool-proof component.

The first seat body 11 comprises a baffle part 27 at an end facing the sewer tube 1. The baffle part 27 ensures correct operation of the water dispenser by blocking garbage in waste water at the end of the swing component 7 when the waste water is drained from the water dispenser. In some embodiments, the end of the swing component 7 contacts the baffle part 27 closely, when the swing component 7 is swung to the highest point toward the sewer tube 1. The baffle part 27 can also be arranged on a side wall of the sewer tube 1.

The connecting pole 2 comprises an elastic snap joint 28 on an end near the swing component 7. The elastic snap joint 28 comprises a bayonet 29, and one end of the swing component 7 is snapped in the bayonet 29. In this way, the connecting pole 2 can be inserted from an end of the sewer tube 1 after the end of the swing component 7 is inserted into the sewer tube 1 during assembly, and then the end of the swing component 7 is snapped into the bayonet 29 to complete the assembly. Assembly and disassembly can be performed more effectively. Since one end of the swing component 7 is snapped into the bayonet 29, the connecting pole 2 can be removed for cleaning when needed.

The end of the swing component 7 snapped in the elastic snap joint 28 is an upwardly curved arc. The upper part of the arc points upwards for supporting an upward movement of the connecting pole 2 when the swing component 7 swings upwards. The curved shape allows the highest point of the arc to stay in contact the middle of the bottom of the connecting pole 2 during the upward movement of the connecting pole 2. The thrust force would be consistently applied to the middle of the bottom of the connecting pole 2 such that the connecting pole 2 would not deviate from its track during the upward movement. Stability of the connecting pole 2 and the entire structure is guaranteed. The highest point of the arc still stays in contact the middle of the bottom of the connecting pole 2 during a downward movement of the connecting pole 2 due to gravity on the connecting pole 2 and the sewer lid 5 if the swing component 7 swings downward. The supporting force would be consistently applied to the middle of the bottom of the connecting pole 2 such that the connecting pole 2 would not deviate from its track during the downward movement. The lower part of the curved art is shaped as a curved hook which pulls the connecting pole 2, and in turn, the sewer lid 5 downwards in case the gravity on the connecting pole 2, the sewer lid 5 and other components is not enough to pull the connecting pole 2 downwards.

As shown in FIG. 12-15, the elastic snap joint 28 comprises a guiding component outside the bayonet 29 to guide the end of the swing component 7 until it is snapped in the bayonet 29. The guiding component comprises a first orienting block 39 and a second orienting block 40 arranged on the bayonet 29 of the elastic snap joint. Orienting surfaces 41 are provided on opposite surfaces of the first orienting block 39 and the second orienting block 40. The orienting surface 41 is a spiral with one end higher and the other end lower. The orienting surface 41 on the first orienting block 39 and the orienting surface 41 on the second orienting block 40 are arranged centrosymmetrically. During assembly, one end of the swing component 7 is inserted into the sewer tube 1 after the swing component 7 is fixed, and after that the connecting pole 2 is inserted from an end of the sewer tube 1. At such a phase, it is difficult to see within the sewer tube 1 with bare eyes, but the above mentioned structures enables the elastic snap joint 28 to rotate due to gravity when the orienting surface 41 contacts the end of the swing component 7 even if the bayonet 29 of the elastic snap joint 28 misaligns with the end of the swing component 7. The elastic snap joint 28 stops after it rotates to a position where the end of the swing component 7 can be fitted into the bayonet 29, and the end of the swing component 7 can be fitted into the bayonet 29 at this point by applying some force.

The connecting pole 2 and the sewer tube 1 comprise orienting components which are mutually clamped. The orienting component comprises orienting plates 30 arranged on a side of the connecting pole 2 and orienting ribs 31 arranged on the inner wall of the sewer lid 1. An orienting slit 32 is formed between adjacent orienting ribs 31. The orienting plate 30 is slidably connected to the orienting slit 32. Such orienting components guide the vertical movement of the connecting pole 2 and prevent movement disorder. Consistency among every movement must be ensured to ensure stability of the water dispenser in use. The orienting components also prevent circumferential rotation of the connecting pole 2 in vertical movement and further enhance stability.

Limiting ribs 33 are arranged circumferentially on the inner wall of the sewer tube 1 and outside the orienting slits 32 to prevent insertion of the orienting plates 30 into the sewer tube 1 in positions of the limiting ribs 33. The largest distance between limiting ribs 33 is less than the smallest distance between the orienting plates 30. Assembly would be more convenient using this configuration now that the orienting plates 30 can only be slidable within the orienting slits 32 since the limiting ribs 33 prevent insertion of the orienting plates 30 into the sewer tube 1 in positions of the limiting ribs 33. In embodiments where one end of the swing component 7 is fitted to the bayonet 29, the limiting ribs 33 provide increased assembling accuracy, convenience and efficiency.

Sliding ribs 34 are provided between the ends of the limiting ribs 33 and the ends of the orienting ribs 31. The ends of the limiting ribs 33 are connected to the ends of the orienting ribs 31 by the sliding ribs 34. The orienting plates 30 are more readily mounted to the orienting slits 32 with the aid of the limiting ribs 33. Assembly is thus more convenient.

An anti-skid structure is provided between an outer wall of the body component 22 and the end of the tweaking component 23 which protects the tweaking component 23 from loosening when it is screwed to the body component 22. The anti-skid structure comprise a radical flange 35 one the outer side wall of the body component 22. The radical flange 35 comprises first teeth 36 on an end face facing the tweaking component 23. The tweaking component 23 comprises second teeth 37 on its end. The first teeth 36 engage with the second teeth 37 when the tweaking component 23 is screwed to the body component 22. In some embodiments, the first teeth 36 and the second teeth 37 are inverted to each other. The first teeth 36 and the second teeth 37 prevents loosening of the tweaking component 23 when the tweaking component 23 is screwed to the body component 22, and prevents decreasing of friction force between the inner surface of the round cavity 15 and the outer surface of the spherical ball 14 which leads to inability to keep the swing component in any determined position. Stability of the water dispenser in user can be further ensured.

A sealing ring 38 is arranged on the outer wall of the mounting cassette 18. The top of the sealing ring 38 is in close contact with the inner wall of the body component 22. The sealing ring 38 stays motionless on the sealing ring 38 in use and thus better sealing effects are provided.

The work flow of the using water dispenser is as follows: the handle 10 actuates the connecting steel wire 9. The connecting steel wire 9 then actuates the swing component 7 to swing. The other end of the swing component 7 is used to drive the connecting pole 2 to move vertically in the sewer tube 1 such that the sewed lid opens or closes the sewer outlet 3. Since a limiting component to keep the swing component 7 in any determined position during swinging is arranged between the swing component and the swing component mounting seat 8, the swing component 7 and the sewer lid 5 may stay in any determined position in the course of movement. Therefore, the opening left uncover by the sewer lid 5 on the sewer outlet can be adjusted by operating the handle 10 correspondingly. Usage of the water dispenser becomes more convenient as a technical advantage is provided in changing an existing water dispenser which has only a closed state and an open state. The water dispenser of the present disclosure can be used in bathtubs, kitchen sinks, washing basins and other places.

Although certain embodiments have been illustrated and described herein for purposes of description, a wide variety of alternate equivalent embodiments or implementations to achieve the same purposes may be substituted for the embodiments shown and described without departing from the scope of the present disclosure. This application is intended to cover any adaptations or variations of the embodiments discussed herein.

I claim:

1. A water dispenser, comprising a sewer tube, a connecting pole, a connecting seat having a sewer outlet, and a sewer lid to close or open the sewer outlet, wherein the connecting seat is connected to the sewer tube; the connecting pole is inside the sewer tube; the sewer lid is connected to an upper end of the connecting pole; the sewer tube comprises a fixing seat on a side wall; the fixing seat comprises a driving component to drive the connecting pole; the driving component comprises a swing component, a swing component mounting seat, a connecting steel wire and a handle; the swing component is hinged to the swing component mounting seat to enable the swing component to swing with a hinge shaft as a center; the handle is connected to an end of the connecting steel wire; the other end of the connecting steel wire is connected to an end of the swing component; the other end of the swing component is used to drive the connecting pole to move along the sewer tube so that the sewer lid closes or opens the sewer outlet; a limiting component is arranged between the swing component and the swing component mounting seat to limit the swing component so that the swing component can stay in a determined position during swinging; the swing component mounting seat comprises a first seat body and a second seat body; the first seat body is located on a side of the swing component which is near the sewer tube; the second seat body is located on a side of the swing component which is away from the sewer tube; the first seat body and the second seat body comprise a swing component mounting cavity; the swing component is arranged in the swing component mounting cavity; and wherein the swing component comprises a spherical ball, the swing component mounting cavity comprises a round cavity adapted to the spherical ball, and the friction force induced by contact of an inner surface of the round cavity with an outer surface of the spherical ball causes the swing component to stay in the determined position during swinging.

2. The water dispenser of claim 1, wherein a pad is arranged between the round cavity and the spherical ball.

3. The water dispenser of claim 1, wherein the fixing seat comprises a mounting cassette, the mounting cassette comprising a receiving cavity to receive the second seat body; and the mounting cassette and the first seat body comprise clamping components which are mutually clamped.

4. The water dispenser of claim 3, wherein the fixing seat comprises a body component arranged on a side wall of the sewer tube and a tweaking component screwed to the body component; the tweaking component comprises a mounting cassette receiving chamber to receive the mounting cassette; the mounting cassette is arranged within the mounting cassette receiving chamber; a gap is formed between the first seat body and the second seat body; an elastic gasket is arranged between the mounting cassette and a bottom of the mounting cassette receiving chamber; and a jump ring is clamped on an outer wall of the mounting cassette.

5. The water dispenser of claim 3, wherein the first seat body is mounted on the body component, and a fool-proof component is arranged between the first seat body and the body component.

6. The water dispenser of claim 1, wherein the first seat body comprises a baffle part at an end facing the sewer tube.

* * * * *